US007774869B2

(12) United States Patent
Massey, Jr.

(10) Patent No.: US 7,774,869 B2
(45) Date of Patent: Aug. 17, 2010

(54) PORTABLE TOILET SEAT COVER

(76) Inventor: William Yates Massey, Jr., 2900 Pumpkin St., Clinton, MD (US) 20735

( * ) Notice: Subject to any disclaimer, the term of this patent is extended or adjusted under 35 U.S.C. 154(b) by 0 days.

(21) Appl. No.: 12/488,935

(22) Filed: Jun. 22, 2009

(65) Prior Publication Data

US 2009/0255040 A1 Oct. 15, 2009

Related U.S. Application Data

(63) Continuation of application No. 11/308,001, filed on Mar. 2, 2006, now abandoned.

(51) Int. Cl.
*A47K 13/14* (2006.01)

(52) U.S. Cl. ..... 4/245.1; 4/245.8; 4/245.9

(58) Field of Classification Search ..... 4/245.1–245.9
See application file for complete search history.

(56) References Cited

U.S. PATENT DOCUMENTS 2,312,589 A * 3/1943 Reeves ..... 4/245.3
2,716,244 A * 8/1955 Wendel ..... 4/239
4,766,617 A * 8/1988 Thygesen et al. ..... 4/245.4
4,975,990 A * 12/1990 Chan ..... 4/245.1
5,557,809 A * 9/1996 Adams ..... 4/245.3
5,864,892 A * 2/1999 Cool ..... 4/245.1
6,813,784 B1 * 11/2004 Thompson ..... 4/245.1
7,247,360 B1 * 7/2007 Besner et al. ..... 4/245.1

* cited by examiner

*Primary Examiner*—Khoa D Huynh
(74) *Attorney, Agent, or Firm*—Rothwell, Figg, Ernst & Manbeck, pc

(57) ABSTRACT

A protective toilet seat cover, particularly, but not by way of limitation, provides sanitary protection having a portion to overhang a side of a toilet and a forward bowl flap to hang down along the forward inside portion of a toilet bowl. A toilet seat cover made of a paper material is oversized to cover a toilet seat. Adhesive material may also be placed on the bottom of the toilet seat cover to prevent slipping on a toilet seat. A rear flap folds to contact a portion of the upper surface of the seat cover thereby forming a pocket. An edge of the rear flap may be provided an adhesive. The pocket may contain toiletries, such as personal wipes. The toilet seat cover may be folded and packaged with a disinfectant wipe, providing a convenient kit package for carrying and use.

10 Claims, 4 Drawing Sheets

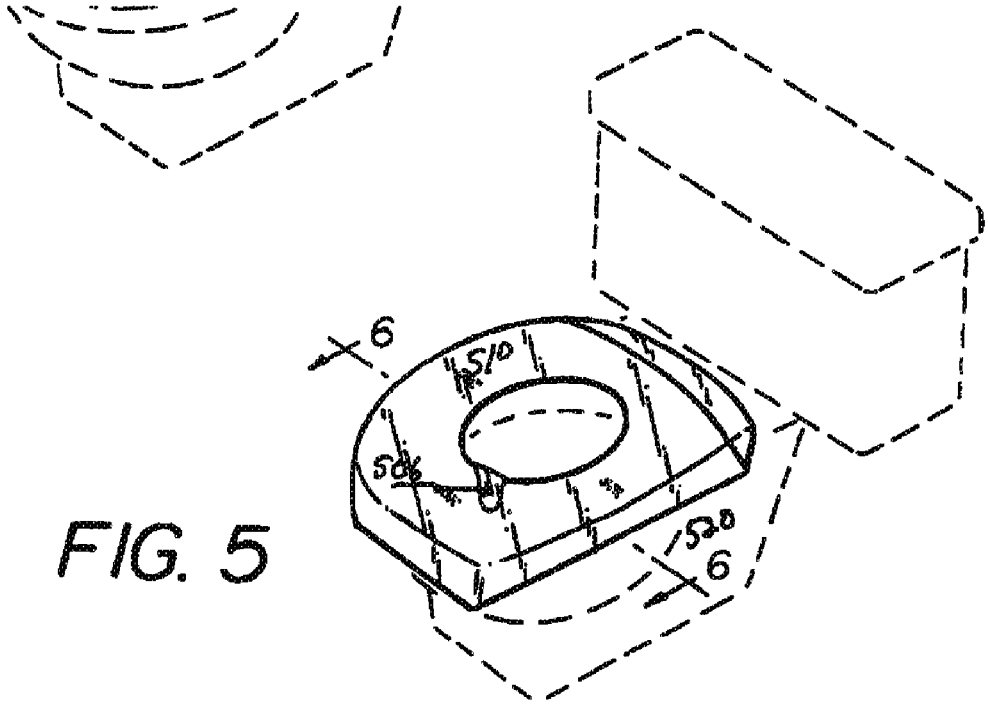
FIG. 5
FIG. 6
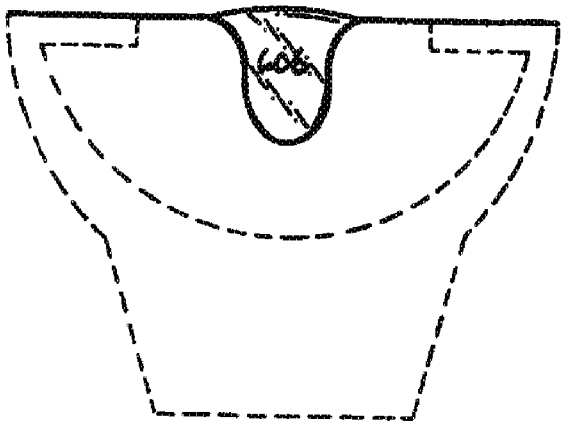
FIG. 7
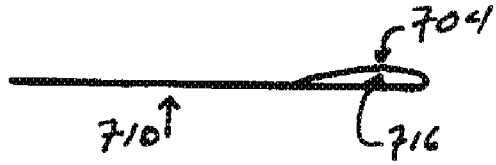

PORTABLE TOILET SEAT COVER

CROSS REFERENCE TO RELATED APPLICATIONS

This application is a continuation of U.S. application Ser. No. 11/308,001, filed Mar. 2, 2006, which is incorporated herein in its entirety now abandoned.

FIELD OF THE INVENTION

The present disclosure relates generally to protective toilet seat covers, and particularly, but not by way of limitation, to a toilet seat cover providing sanitary protection having a portion to overhang a side of a toilet and a forward bowl flap to hang down along the forward inside portion of a toilet bowl. A toilet seat cover made of a paper material is oversized to cover a toilet seat. Adhesive material may also be placed on the bottom of the toilet seat cover to prevent slipping on a toilet seat. A rear flap folds to contact a portion of the upper surface of the seat cover thereby forming a pocket. An edge of the rear flap may be provided an adhesive. The pocket may contain toiletries, such as personal wipes. The toilet seat cover may be folded and packaged with a disinfectant wipe, providing a convenient kit package for carrying and use.

BACKGROUND OF THE INVENTION

Restrooms, and in particular public restrooms, are often unsanitary and potentially unhealthy. There are many different sanitary toilet seat covers used to avoid the unsanitary and potentially unhealthy contact with a toilet seat during use. One such toilet seat cover is disclosed in U.S. Pat. No. 6,073,274, to McQueen, discloses a sanitary toilet seat cover having waterproof material affixed to a layer of porous material impregnated with an antibacterial solution. Adhesive patches are also used to temporarily affix the seat cover to a toilet seat. Another toilet seat cover is disclosed in U.S. Pat. No. 4,975,990, to Chan, disclosing a splash suppressing toilet seat cover made of paper. A zigzag or fanfold portion extends across the center portion. Another sanitary toilet seat cover is disclosed in U.S. Pat. No. 1,036,623, to Hopkinson, disclosing a shield or protector that has a blank or tongue-like forming member being turned or folded back under the seat sitting portion. U.S. Pat. No. 6,813,784, to Thompson, discloses a toilet seat cover made of paper having handgrips.

Prior sanitary toilet seat covers have not been suitable in protecting against contact with the forward inner bowl surfaces.

Prior sanitary toilet seat covers have not provided a pocket to contain toiletries.

Prior sanitary toilet seat covers have not been packages with toiletries as part of a kit.

SUMMARY OF THE INVENTION

An aspect of the invention provides a protective toilet seat cover. According to an aspect, a toilet seat cover comprises a seat portion adapted to be placed on a toilet seat. According to an aspect, the toilet seat cover has a seat portion having a longitudinal length longer than a standard toilet seat, at least a portion of the length adapted to overhang the forward portion of the toilet bowl. According to an aspect, the toilet seat cover has a seat portion having a width substantially greater than the width of a standard toilet seat, at least a portion of said width adapted to overhang at least one side of said toilet seat. According to an aspect, the toilet seat cover has a forward bowl flap extending inwardly from a front side of said seat portion and adapted to hang downward adjacent an inner face of a forward bowl portion of said toilet seat.

According to an aspect, the toilet seat cover has a rear flap extending from a back side of said seat portion, wherein said flap foldably contacts a portion of an upper surface of said seat portion to form a pocket.

According to an aspect, the toilet seat cover is provided with an adhesive portion placed on at least a part of the seat portion. According to an aspect, the adhesive is disposed to adhere to a portion of the toilet seat. According to an aspect, at least a portion of the rear flap is provided with adhesive such that the adhesive is disposed to adhere to a rear portion of the toilet seat cover to define a pocket. According to a further aspect, at least one toiletry may be received by the pocket.

According to an aspect, toiletry suitable for inclusion in the kit of the present invention include, but are not limited to: moistened towelettes for sanitizing the toilet seat, wipers for personal hygiene, hand towels, lotions, soaps, and mixtures thereof.

According to an aspect, the toilet seat cover is packaged as part of a kit. The kit may include at least one toiletry. The kit may include a packet containing a plurality of toiletries.

According to an aspect, the protective toilet seat cover is made of a paper. According to an aspect, the protective toilet seat cover is made of a paper capable of being flushed. According to an aspect, the protective toilet seat cover is provided informational and/or decorative indicia printed thereon.

According to an aspect, the protective toilet seat cover has a waterproof material affixed to a surface wherein the waterproof material is disposed to contact the toilet seat. According to an aspect, the waterproof material is further disposed to contact the toilet seat lid when the lid is in the raised position.

According to an aspect, the protective toilet seat cover is packaged as part of a kit. According to an aspect, the protective toilet seat cover may be folded and packaged with a wipe, providing a convenient package for carrying and use. According to an aspect, the wipe may be a disinfectant wipe. According to an aspect, the wipe may be flushable.

These and other objects, advantages, and features will become more readily apparent in view of the following detailed description. Still other aspects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

FIG. 5 is a top plan perspective view of the present invention mounted on a toilet seat;

FIG. 6 is a forward cross-section through line 6-6 of FIG. 5.

FIG. 7 is a cross section, taken along line 7-7 in FIG. 4;

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Reference is made to the figures to illustrate selected embodiments and preferred modes of carrying out the invention. It is to be understood that the invention is not hereby limited to those aspects depicted in the figures.

Figure 1:
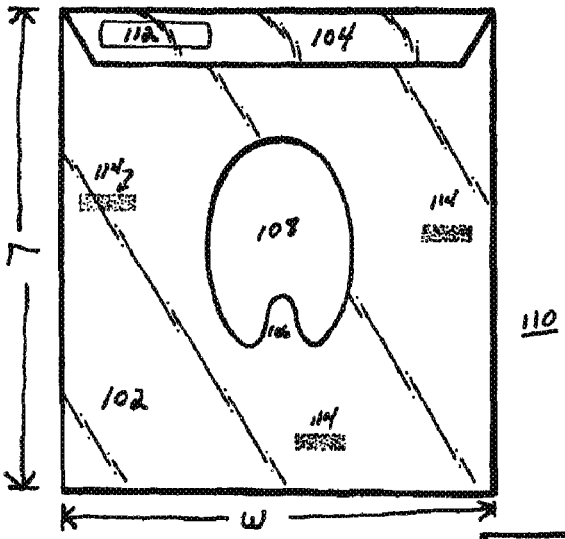
FIG. 1 is a top plan view of a toilet seat cover.

FIG. 1 is a top plan view of a protective toilet seat cover 110. Protective toilet seat cover 110 comprises a seat portion 102 adapted to be placed on a toilet seat. Seat portion 102 has a central void 108 defined therethrough. The seat portion 102 has a longitudinal length L. Preferably, length L is substantially greater than that of a standard toilet seat. At least a portion of length L is adapted to overhang the front portion of the toilet seat. The overhanging portion is adapted to protect the clothing and/or skin of a user of the seat cover. The seat portion 102 has a width W. Preferably, width W is substantially greater than that of a standard toilet seat, at least a portion of said width is adapted to overhang at least one side of the toilet seat. A forward bowl flap 106 extends inwardly from a front side of said seat portion 102 and is adapted to hang downward adjacent an inner face of a forward bowl portion of a toilet seat. Forward bowl flap 106 operates to protect the user's body from contacting the forward inner surface of the toilet bowl. A rear flap 104 extends from a back side of said seat portion 102. Flap 104 foldably contacts a portion of the upper surface of seat portion 102 to form a pocket. The pocket may receive a personal wipe or a packet containing a plurality of wipes. Flap 104 may be adhered to seat portion 102 by an adhesive. Numeral 112 indicates a packet location within the pocket defined by flap 104 wherein a wipe or packet may be located.

In a first embodiment, the seat portion has a central void defined therein. In a second embodiment, the seat portion has a plurality of perforations disposed to permit the formation of a central void in said seat portion. Instructions may be supplied with the seat cover instructing a user to remove a central portion of the seat cover by tearing along the perforations. The instructions may be separately supplied or the instructions may be printed on a portion of the seat cover.

Figure 2:
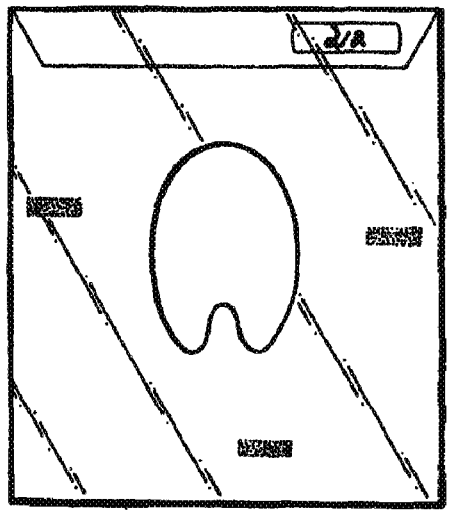
FIG. 2 is a top plan view of a second embodiment.

FIG. 2 is a top plan view of an alternative embodiment of protective toilet seat cover 110 showing an alternative placement of packet location 212.

Figure 3:
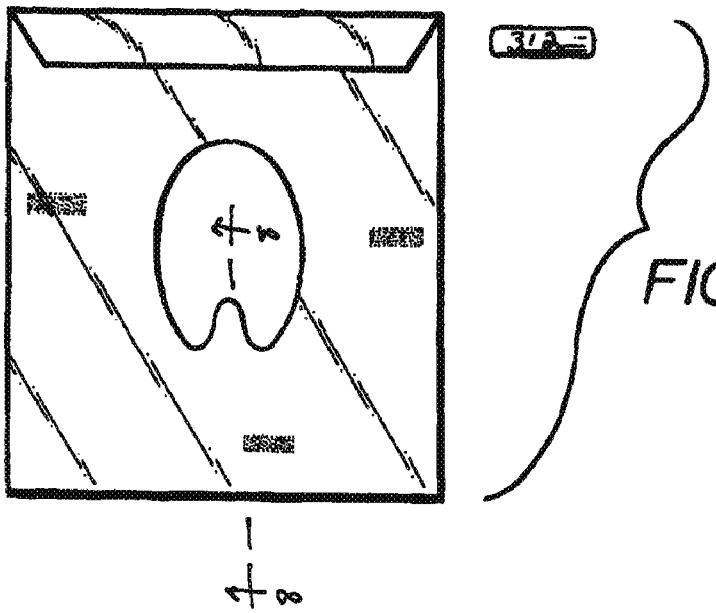
FIG. 3 is a top plan view of a toilet seat cover with a wiper packet.

FIG. 3 is a top plan view of a protective toilet seat cover 110 showing toiletry packet 312 separately from the seat cover. A form of toiletry may be a personal hygienic wipe which may be supplied with the seat cover. The wipe is disposed to be received by a pocket formed by folding a rear portion of seat cover 110. A plurality of wipes may be supplied. The wipe or plurality of wipes may be packaged in a packet. Such packet is disposed to be received by the pocket. The wipe may be made of any suitable material. A non-limiting example is paper. The wipe may be treated with a disinfectant material. The wipe may be treated with a moisturizing material. Preferably, the wipe is flushable. Preferably, the wipe is biodegradable. Packet 312 is not limited to wipes. Any suitable toiletry may be held by packet 312. Toiletries suitable for inclusion in the kit of the present invention include, but are not limited to: moistened towelettes for sanitizing the toilet seat, wipers for personal hygiene, hand towels, lotions, soaps, and mixtures thereof.

Figure 4:
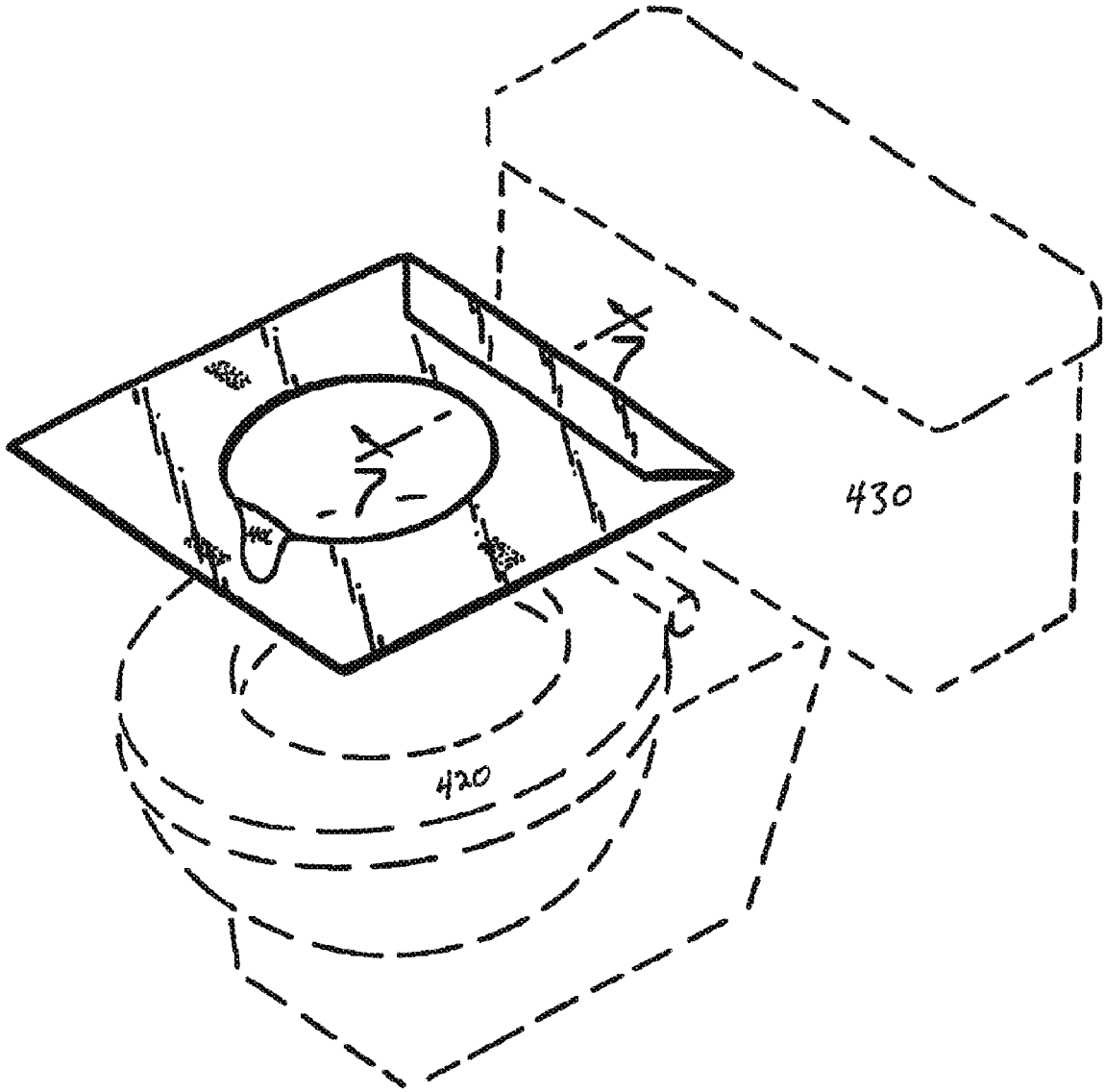
FIG. 4 is a top plan perspective view of the present invention oriented relative to a toilet seat.

FIG. 4 is a top perspective view showing a protective toilet seat cover 410 oriented with respect to a toilet seat 420.

FIG. 5 is a top perspective view showing a protective toilet seat cover 510 mounted on a toilet seat 520. Forward bowl flap 506 is shown hanging down in the bowl. Portions of seat cover 510 and toilet seat 520 are shown cut away. FIG. 5 also illustrates a toilet seat cover 510 having a length adapted to overhang a front portion of a toilet seat 520 and a width adapted to overhang a side of the toilet seat 520.

FIG. 6 is a cross-section, viewed towards the front, cut along line 6-6 in FIG. 5. Forward bowl flap 606 is shown hanging down in the bowl.

FIG. 7 is a cross-section, viewed towards the side, cut along line 7-7 in FIG. 4. Rear flap 704 is shown folded over and adhesively attached to the rear portion of seat portion 710 to form pocket 716 for receiving a wipe or packet of wipes (not shown).

Figure 8:
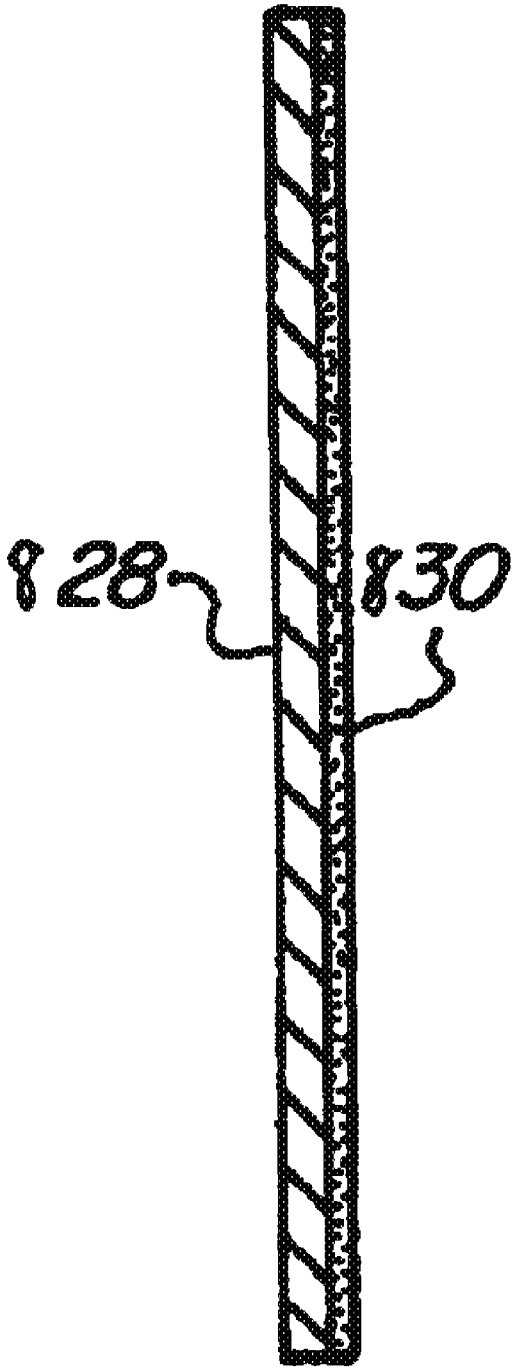
FIG. 8 is a side elevation of an embodiment.

FIG. 8 is a cross-section cut through line 8-8 in FIG. 3. FIG. 8 illustrates the structure of the toilet seat cover. Any suitable material, such as, but not limited to a paper material 828, has an adhesive or tacky material coating 830 thereon. The adhesive or tacky material coating 830 prevents the toilet seat cover from sliding on the toilet seat. The adhesive or tacky material coating may cover the entire underside surface of the toilet seat cover 828, which comes in contact with the toilet seat or only a portion thereof. The adhesive may be sprayed on. The adhesive or tacky material coating 830 need not cover the entire surface of the toilet seat protector 828, but only a portion thereof. The portion that is not coated with adhesive may be used when folded over to protect the adhesive coated portions.

The any suitable material, such as, but not limited to a paper material 828 may be a soft cushion constructed of a material similar to household toilet paper. The paper material 828 may be one or multiple ply paper or other fibrous material. Preferably, paper material 828 is disposable, hypoallergenic, and biodegradable. More preferably, paper material 828 is readily flushable. The paper material 828 may also be treated with an antibacterial agent for further germicidal protection.

Figure 9:
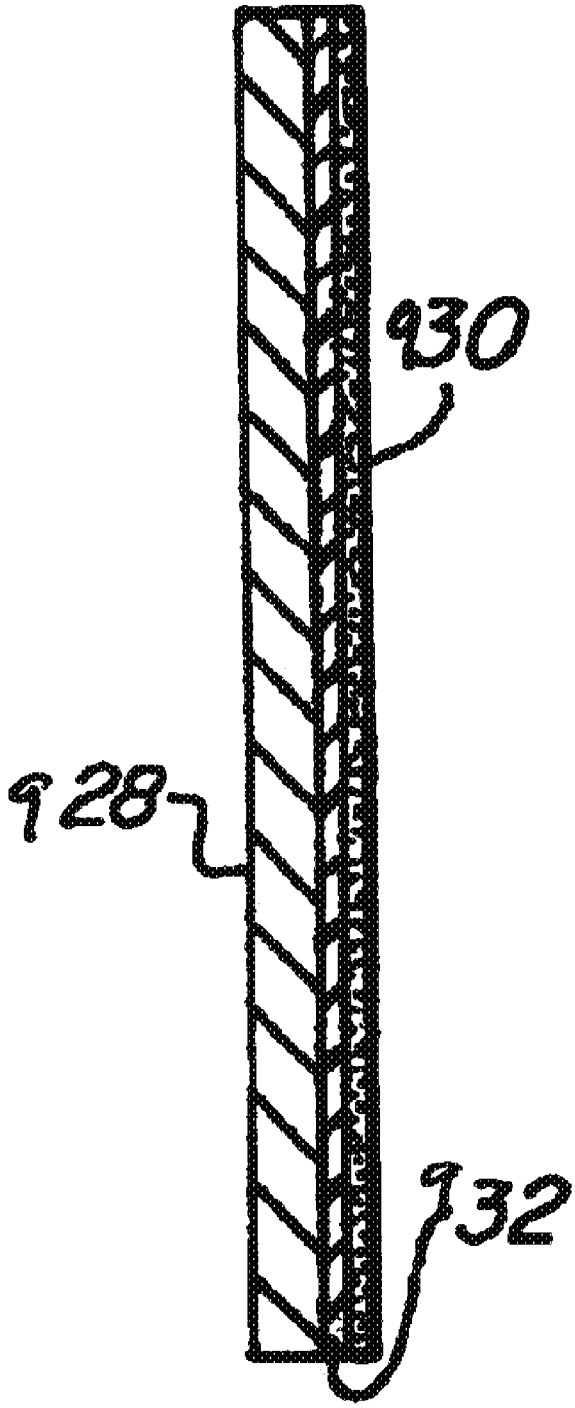
FIG. 9 is a side elevation of a second embodiment.

FIG. 9 illustrates a preferred embodiment of a toilet seat cover. A paper material 928 may have a moisture barrier layer 932 and an adhesive tacky material coating 930 placed thereon. The moisture barrier layer 932 prevents any moisture that may be on the toilet seat from soaking through to the absorbent paper material 928.

A protective toilet seat cover is packaged as part of a kit. According to an aspect, the protective toilet seat cover may be folded and packaged with a wipe, providing a convenient package for carrying and use. According to an aspect, the wipe may be a disinfectant wipe. According to an aspect, the wipe may be flushable. According to an aspect, a plurality of wipes is supplied. Suitably, the wipe or wipes is (are) packaged in a packet.

Furthermore, it is to be understood that the form of the invention shown and described is to be taken as presently preferred embodiments. Various modifications and changes may be made to each and every processing step as would be obvious to a person skilled in the art having the benefit of this disclosure. It is intended that the following claims be interpreted to embrace all such modifications and changes and, accordingly, the specification and drawings are to be regarded in an illustrative rather than a restrictive sense. Moreover, it is intended that the appended claims be construed to include alternative embodiments.

The entire contents of U.S. Design Pat. D451,178, to William Yates Massey, the inventor of the present invention, are hereby incorporated in their entirety and for all purposes.

What is claimed as new and desired to be protected by Letters Patent of the United States is:

1. A protective toilet seat cover for using with a toilet having a toilet bowl and a toilet seat placed on top of said toilet bowl, comprising:

a seat portion adapted to be placed on said toilet seat, said seat portion having a length and a width, said seat portion having a front side and a back side, said seat portion having a central void defined therein;

a forward bowl flap extending inwardly from said front side of said seat portion and adapted to hang downward into said toilet bowl into said central void and adjacent an inner face of a forward bowl portion of said toilet seat;

a rear flap extending upwardly from said back side of said seat portion, wherein said flap is designed to foldably contact a portion of an upper surface of said seat portion to form a pocket; and an adhesive is disposed on said rear flap and designed to adhere to a free edge of said rear flap of said portion of said upper surface of said seat portion of said seat cover when said rear flap is folded down.

2. The protective toilet seat cover as in claim 1, further comprising at least one personal wipe disposed to be received by said pocket.

3. The protective toilet seat cover as in claim 1, wherein at least a portion of said length is adapted to overhang a front portion of said toilet seat.

4. The protective toilet seat cover as in claim 1, wherein at least a portion of said width is adapted to overhang at least one side of said toilet seat.

5. The protective toilet seat cover as in claim 1 further comprising:

adhesive placed on at least a portion of said seat portion, said adhesive disposed to adhere to said toilet seat.

6. The protective toilet seat cover as in claim 1 wherein said protective toilet seat cover is made of a paper.

7. The protective toilet seat cover as in claim 6 wherein said paper is capable of being flushed.

8. The protective toilet seat cover as in claim 1 further comprising a waterproof material affixed to a surface of said toilet seat cover wherein said waterproof material is disposed to contact said toilet seat.

9. A kit comprising:

at least one toiletry;

and at least one protective toilet seat cover for using with a toilet having a toilet bowl and a toilet seat placed on top of said toilet bowl, comprising:

a seat portion adapted to be placed on said toilet seat, said seat portion having a length and a width, said seat portion having a front side and a back side, said seat portion having a central void defined therein;

a forward bowl flap extending inwardly from said front side of said seat portion and adapted to hang downward into said toilet bowl into said central void and adjacent an inner face of a forward bowl portion of said toilet seat;

a rear flap extending upwardly from said back side of said seat portion, wherein said flap is designed to foldably contact a portion of an upper surface of said seat portion to form a pocket disposed to receive at least one toiletry, and an adhesive is disposed on said rear flap and designed to adhere to a free edge of said rear flap of said portion of said upper surface of said seat portion of said cover when said rear flap is folded down.

10. The kit of claim 9 wherein said at least one toiletry is selected from the group consisting of moistened towelettes, personal hygiene wipes, hand towels, lotions, soaps, and mixtures thereof.

* * * * *